United States Patent [19]

Grigsby

[11] 4,166,441

[45] Sep. 4, 1979

[54] COMPRESSED AIR-ACTUATED FLUID INJECTION APPARATUS

[76] Inventor: Gilbert R. Grigsby, 125 W. Ave. 29, Los Angeles, Calif. 90031

[21] Appl. No.: 823,398

[22] Filed: Aug. 9, 1977

[51] Int. Cl.[2] ..... F02M 1/16

[52] U.S. Cl. ..... 123/180 R; 123/179 F

[58] Field of Search ..... 123/180 R, 180 AC, 179 F; 222/335, 340

[56] References Cited

U.S. PATENT DOCUMENTS

| | | | |
|---|---|---|---|
| 1,693,732 | 12/1928 | Stokes | 123/180 R |
| 2,130,666 | 9/1938 | Coffey | 123/180 R |
| 2,731,250 | 1/1956 | Yon | 123/180 R |
| 2,905,165 | 9/1959 | Hall | 123/180 R |
| 2,931,349 | 4/1960 | Nicolodi | 123/179 F |
| 3,416,507 | 12/1968 | Little | 123/180 R |
| 3,620,424 | 11/1971 | Grigsby | 222/416 |
| 3,722,209 | 3/1973 | Kaytor | 123/179 F |
| 3,788,283 | 1/1974 | Perry | 123/180 R |
| 3,999,531 | 12/1976 | Taylor | 123/179 F |

FOREIGN PATENT DOCUMENTS

| | | | |
|---|---|---|---|
| 962267 | 6/1950 | France | 123/180 R |

*Primary Examiner*—Charles J. Myhre
*Assistant Examiner*—David D. Reynolds

[57] ABSTRACT

An injector apparatus particularly suited for injecting starting fluid into the cylinders of an internal combustion engine can be operated by the on-board compressed air system of a vehicle. The air, which may be taken from an air-driven starter motor or an air brake system, is used to actuate a piston causing starting fluid to be expelled from a metering chamber into the fuel cylinders of the vehicle's engine. The metering chamber is then refilled from a pressurized reservoir.

28 Claims, 6 Drawing Figures

COMPRESSED AIR-ACTUATED FLUID INJECTION APPARATUS

BACKGROUND OF THE INVENTION

The present invention relates to an injection apparatus particularly suitable for injecting starting fluid into the cylinders of an internal combustion engine, and more particularly to such an apparatus operated by the on-board compressed air system of a motor vehicle.

An internal combustion engine can be started more quickly and easily if a charge of starting fluid, such as ether, or preferably a combination of ether and a lubricant, is injected into the cylinders along with the regular fuel supply. Various devices have been attached to engines that provide a pressurized supply of starting fluid and a valve that permits a charge to be injected at the appropriate time. Some such devices simply allow the valve to be operated manually at will by a remote cable control. A more sophisticated device, described in this inventor's U.S. Pat. No. 3,620,424, issued on Nov. 16, 1971, provides for automatic injection of a predetermined quantity of starting fluid when the engine's starter motor is operated.

The automatic injector referred to above utilizes a solenoid to operate two valves in sequence whenever the starter motor is energized. A first valve permits starting fluid to escape from a pressurized tank or reservoir into a resilient metering chamber. When the injector is actuated, a second valve permits the predetermined quantity of fluid contained by the metering chamber to be expelled through a starting fluid delivery conduit into the engine. This device insures that a measured quantity of starting fluid is injected each time the engine is started. Since its operation is automatic, it can prevent the injection of starting fluid after the engine has been warmed up, thereby avoiding engine damage that could otherwise result.

Starting fluid injectors have proven particularly suitable for use with large diesel-powered vehicles since a diesel engine is not started and self-sustaining until it is able to maintain the minimum internal temperature required to cause combustion upon compression of the air-fuel mixture. Engines equipped with compressed air-operated starter motors must reach this minimum starting temperature before their reserve of compressed air is exhausted if the expense and time loss of bringing a large portable compressor to the vehicle is to be avoided. If an electrically powered starter is used, similar limitations are imposed by the amount of energy available from the vehicle's battery.

When there is doubt about the ability to restart an engine, it must be left to idle, consuming expensive fuel and contributing to air pollution. It is therefore highly desirable to simplify the starting fluid injecting mechanism and to increase its reliability.

SUMMARY OF THE INVENTION

The present invention comprises an improved injector apparatus, particularly suitable for injecting starting fluid into an internal combustion engine that can be operated in a simple and reliable manner by the on-board compressed air system of the vehicle. It therefore takes advantage of the fact that many of the vehicles on which starting fluid injectors are used are equipped with such on-board systems to operate their brakes and sometimes their starter motors as well.

The injector utilizes the same arrangement of a starting fluid reservoir and a metering chamber described in the aformentioned U.S. Pat. No. 3,620,424. The valves of the apparatus are, however, operated by an air cylinder on which a piston is reciprocably disposed. When compressed air is supplied to the cylinder, the movement of the piston causes a charge of fluid to be exhausted from the metering chamber through a fluid-delivery outlet. Upon the return stroke of the piston, the metering chamber is refilled from the reservoir.

In a preferred embodiment of the invention connected to the internal combustion engine of a vehicle having an on-board compressed air system, an enclosed air-tight tank for storing starting fluid under pressure has a starting fluid outlet connected by a first fluid path to the metering chamber. The metering chamber is connected by a second fluid path to the fluid-delivery outlet from which it is supplied to the intake manifold of the vehicle. Outward flow of the fluid from the tank is controlled by a first valve, while flow from the metering chamber to the delivery outlet is controlled by a second valve. The fluid is expelled from the metering chamber, when the second valve is open, by the force of a resilient chamber exhaust mechanism. Sequential operation of the first and second valves is effected by an actuator mechanism which includes an air cylinder and a operating air inlet for allowing compressed air to enter the cylinder. The compressed air operates a piston which in turn causes the proper sequential operation of the first and second valves.

If the vehicle has an air starter, the air cylinder can be connected to a line that supplies compressed air to the starter motor so that the actuation of the injector will automatically coincide with the operation of the starter. It is also possible to connect the mechanism to a continuously pressurized air line, using an electrically-controlled air valve to actuate the device. The air valve can be connected to the control circuit of an electric starter or the electric ignition system of an otto cycle engine. An electric valve arrangement can also be used as an override to permit the driver to inject starting fluid at will when it appears that the engine may stall. A thermostatically controlled disabling switch can be included to prevent indiscriminate operation of the injector after the engine has fully warmed up.

The above and other objects and advantages of this invention will become apparent from the following more detailed description when taken in conjunction with the accompanying drawings.

DESCRIPTION OF THE PREFERRED EMBODIMENT

Figure 1:
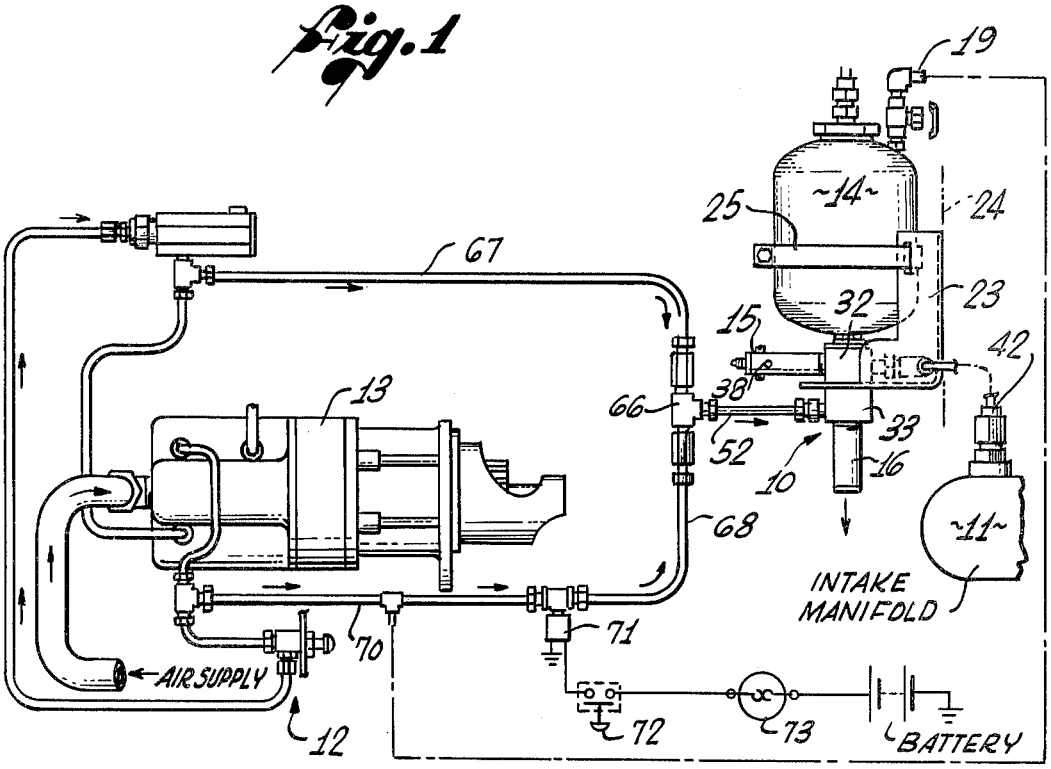
FIG. 1 is a diagrammatic illustration of an exemplary starting fluid injection apparatus connected to the on-board compressed air system of a motor vehicle.

An exemplary injection apparatus 10 embodying many novel features of the present invention is illustrated in FIG. 1 of the accompanying drawings. The apparatus 10 is mounted in the engine compartment of a vehicle that is equipped with an internal combustion engine of the diesel type (of which only the air intake manifold 11 is shown) and an on-board compressed air system 12 that operates an air-driven starter motor 13.

In general, the injection apparatus includes a pressurized starting fluid supply tank 14, a metering chamber 15 which measures a predetermined quantity of fluid, and an air-operated actuator 16 that causes the metering chamber contents to be injected into the cylinders of the engine.

Figure 2:
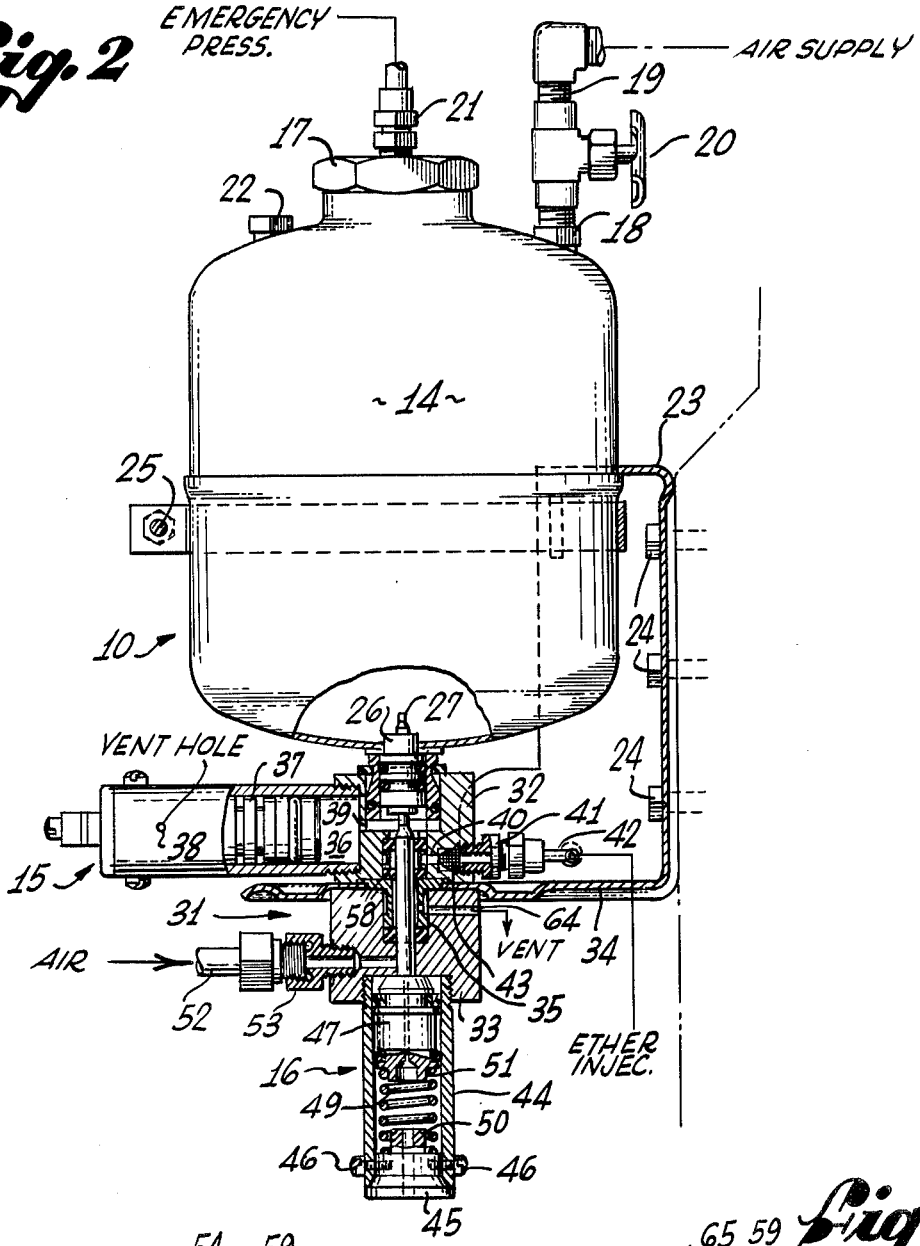
FIG. 2 is an enlarged side view, partially in cross-section, of the injection apparatus.

The tank 14, which serves as a refillable reservoir for the starting fluid, is generally cylindrical, being of airtight construction, as shown in FIG. 2. Starting fluid is added to the tank 14 in liquid form through an opening at the top sealed by a screw-on cap 17. Air pressure is constantly supplied to the top of the tank 14 by a check valve positioned in an air supply inlet 18 and connected to an appropriate continuously pressurized air line 19 of the on-board air system 12. The check valve in the inlet 18 prevents loss of air pressure in the event that pressure supplied by the on-board air system 12 fails. A shutoff valve 20 is provided in the supply line 19. In the event that the air pressure system 12 malfunctions or the tank pressure is too low for some other reason, the tank 14 can be pressurized from any other available source through an auxiliary air supply inlet 21 mounted in the center of the cap 17. A safety valve 22 allows air to escape in the event that the tank pressure exceeds a predetermined maximum, although it will generally be found that, in this non-aerosol system, the tank pressure stays well within safe limits in the environment of the engine compartment. The tank 14 is supported by a bracket 23 attached by bolts 24 to a wall of the engine compartment, the bracket including a flexible metal band 25 clamped around the circumference of the tank.

Figure 4:
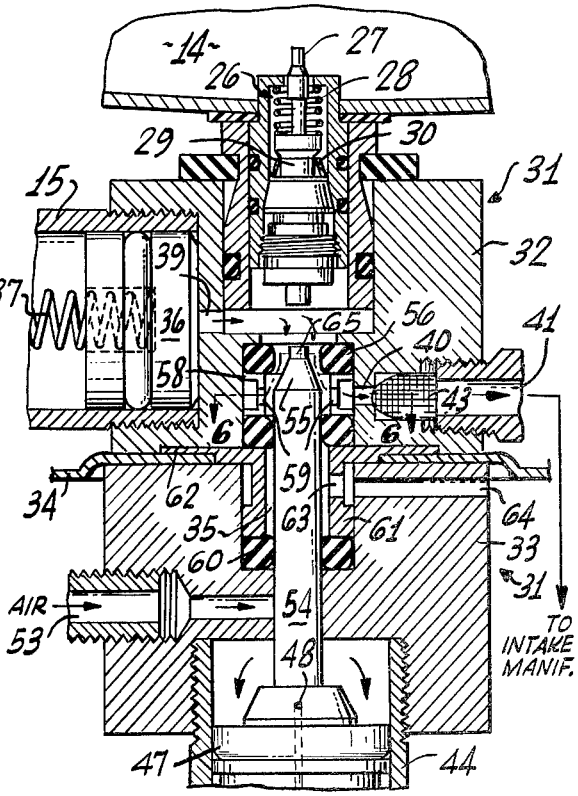
Figure 5:
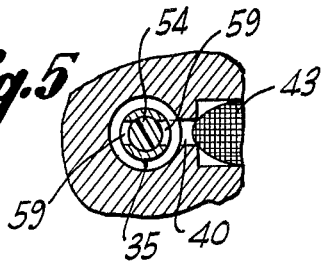
FIGS. 5 and 6 are fragmentary cross-sectional views taken along lines 5—5 and 6—6 of FIGS. 3 and 4, respectively.
Figure 6:
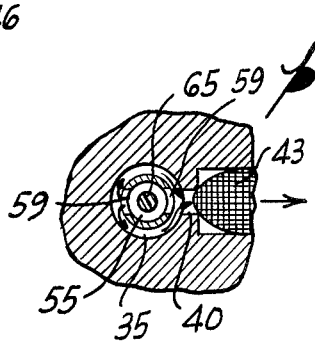

At the bottom of the tank 14 is an outlet in which a valve 26 is positioned to control outward flow of starting fluid. The outlet valve 26, which is of the type commonly used as a tire valve, has an axially movable stem 27 surrounded and engaged by a coil spring 28 that biases the stem downwardly toward a closed position with its head 29 urged against a valve seat 30 (FIGS. 4 and 5).

The outlet valve 26 is supported atop a mounting block 31 made up of aligned upper and lower cylindrical block pieces 32 and 33 with a horizontal plate 34 that forms part of the bracket 23 held between the pieces. Two bolts (not shown) project upwardly from the bottom of the lower block piece 33 through the plate 34, firmly anchoring the block 31 to the bracket 23. A vertical bore 35 extends axially through the center of the block 31 and through an aperture in the plate 34 connecting the outlet valve 26 at the top to the actuator 16 at the bottom.

The metering chamber 15 is horizontally positioned at a level below that of the tank 14 and threadedly received in the side of the upper block piece 32. The chamber 15 forms an elongated cylinder in which a plunger 36 can reciprocate toward and away from the block 31. A coil spring 37 is positioned behind the plunger 36, urging it inwardly toward the block 31 and tending to exhaust the contents of the chamber 15. Venting of air from the back side of the plunger 36 is permitted by a vent hole 38. A first passageway 39 extends horizontally through the block 31 from the chamber 15 to the vertical bore 35, providing a fluid path that connects the chamber to the tank 14 when the outlet valve 26 is open.

On the side of the upper block piece 32 opposite the metering chamber 15, below the level of the first passageway 39, a second passageway 40 connects the bore 35 to a starting fluid delivery outlet 41. A second fluid path is thereby provided leading from the metering chamber 15 through the first passageway 39 to the bore 35, and then through the second passageway 40 to the delivery outlet 41. From the outlet 41, the fluid is supplied by a supply line 42 to the intake manifold 11 (FIG. 2). Any impurities in the starting fluid are blocked by a filter 43 positioned at the outer end of the second passageway 40.

The actuator 16 includes a downwardly projecting air cylinder 44 threadedly attached to the block 31 opposite the tank 14 and in alignment with the bore 35. The bottom end of the cylinder 44 is closed by an end piece 45 which is attached to the walls of the cylinder by two screws 46. A piston 47 is reciprocably disposed within the cylinder 44 for vertical movement toward and away from the tank 14. The sidewalls of the piston 47 are grooved to receive two suitable piston rings. On the opposite side of the piston 47 from the tank 14, a coil spring 49 within the cylinder 44 resiliently biases the piston 47 toward the tank 14, the ends of the spring being positioned by opposing abutments 50 and 51 projecting from the end piece 45 and from the back of the piston.

Compressed air to drive the piston 47 downwardly against the force of the spring 49 is supplied by an air line 52 to an operating air inlet 53 on the side of the lower block piece 33. The air inlet 53 communicates with the cylinder 44 through the lower portion of the bore 35. A very small aperture 48 in the piston 47 permits compressed air to escape from the cylinder 44 through an opening in the end piece 45 to permit the piston to return at a controlled rate, under the force of the spring 49 after it has been driven downwardly by the compressed air.

Figure 3:
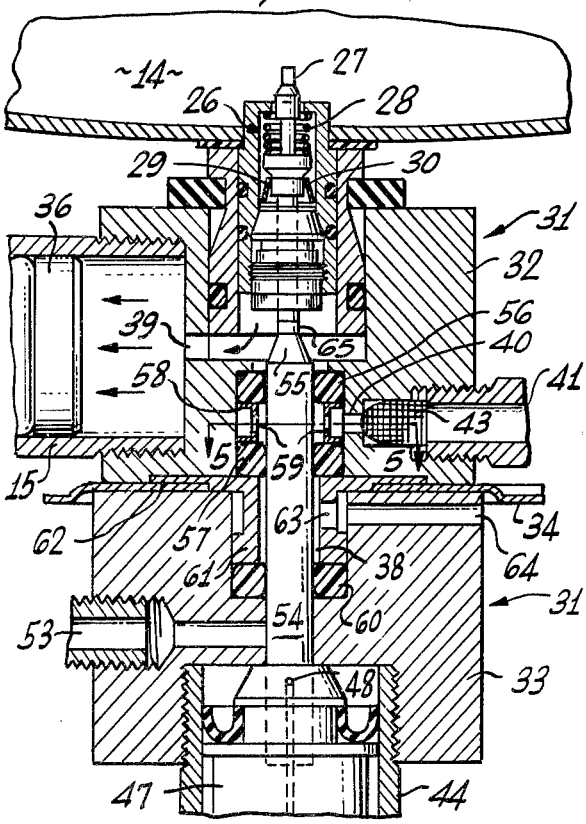
FIGS. 3 and 4 are further enlarged cross-sectional side views of a fragmentary portion of the injection apparatus showing the metering chamber being refilled and exhausted, respectively.

A rod 54 is attached to the top of the piston 47 and projects upwardly along the center of the bore 35, there being sufficient clearance between the rod and the sides of the bore to permit the flow of compressed air from the air supply inlet 41 into the air cylinder 44. The top end of the rod 54 is tapered forming a closure member 55 which, when the piston 47 is at the top of the cylinder 44 (FIG. 3), is inserted in an upper sealing ring 56 that is pressed against the sides of the bore 35. The closure member 55 and the upper sealing ring 56 thus form a valve which controls the flow of fluid from the metering chamber downwardly through the bore 35 to the delivery outlet 41.

A middle sealing ring 57 disposed below the fluid-delivery outlet 41 is separated from the upper sealing ring 56 by an upper spacer 58 in the shape of a spool disposed within the bore 35. When the closure member 55 moves downwardly to open the valve, fluid exhausted from the metering chamber flows through the open center of the upper sealing ring into the center of the spacer 58 and outwardly to the delivery outlet 41 through radial ports 59 in the sides of the spacer.

The middle sealing ring 57 is spaced from a lower sealing ring 60, at the bottom of the bore 35, by a lower spool-shaped spacer 61 having an enlarged horizontal flange 62 at its top end that extends over the top of the bracket plate 34 and is received by an annular recess in the bottom of the upper block piece 32. A radial opening 63 in the side of the lower spacer 61 permits any starting flow that passes the middle sealing ring 57 and any air that passes the bottom sealing ring 60 to escape through a vent 64 in the side of the lower block piece 33. The length and position of the lower spacer 61 are such that the rod 54, at the bottom of its travel, does not disengage the middle and bottom sealing rings 57 and 60.

At the top of the closure member 55, a pin 65 of lesser diameter projects upwardly to engage the outlet valve stem 27. The length of this pin 65 is such that when the piston 47 is at the top of its stroke, the outlet valve 26 is held open, but when the piston 47 moves downwardly, it disengages the pin permitting the valve to close.

When the injector apparatus 10 is in its normal rest position and no compressed air is being supplied to the air cylinder 44, starting fluid can flow freely along the fluid path extending through the open outlet valve 26, into the bore 35, and through the first passageway 39 into the metering chamber 15. The pressure of the fluid pushes the metering chamber plunger 36 outwardly against the force of the spring 37 so that the chamber 15 contains a charge of a predetermined quantity of starting fluid. The closure member 55 engages the upper sealing ring 56 to prevent fluid from flowing through the bore 35 to the delivery outlet 41.

When compressed air is applied to the air supply inlet 53 and the piston 47 moves downwardly, the descending pin 65 allows the outlet valve 26 to close. As the piston 47 descends further, and after the outlet valve 26 has closed, the closure member 55 disengages the upper sealing ring 56. This disengagement opens the second fluid path from the metering chamber 15, through the first passageway 39, down through the bore 35, and out through the second passageway 40 and the supply outlet to the vehicle's intake manifold 11. The metering chamber plunger 36, under the resilient force of the spring 37, causes all fluid in the chamber 15 to be exhausted quickly and positively. It should be noted that only the predetermined quantity of fluid present in the metering chamber 15 is injected regardless of the length of time for which air pressure is applied to the actuator 16.

Once the supply of compressed air to the air inlet 53 is discontinued, the air in the cylinder 44 gradually escapes through the aperture 48 in the piston 47, allowing the piston to rise to the top of the cylinder under the force of the piston bias spring 49. As the closure member 55 moves upwardly through the bore 35, it engages the upper sealing ring 56 to block the fluid path from the metering chamber 15 to the air delivery outlet 41. Thereafter, the pin 65 opens the outlet valve 26, allowing the chamber 15 to be refilled from the tank 14.

In the exemplary arrangement of FIG. 1, the air supply line leads to a T-connection 66 that allows it to receive air from either of two air lines 67 and 68. One air line 67 from the T-connection 66 leads to a starter lockout valve 69, a conventional component of a vehicle equipped with an air starter. This line supplies compressed air to the actuator 16 whenever the air-driven starter motor 13 is operated, providing for automatic actuation of the injector 10 to inject a single charge of starting fluid each time the engine is started.

The second line 68 from the T-connection 66 leads to a line 70 in which there is continuous pressure, the flow of air through this line being controlled by an electrically-operated valve 71. To operate this control valve 71, injecting a charge of starting fluid into the engine at will, a control switch 72 is provided on the dashboard of the vehicle.

The ability to inject starting fluid into the engine at will can be useful, particularly if the engine shows signs of stalling shortly after it has been started and before it has fully warmed up. Nevertheless, engine damage can result if the injector 10 is operated indiscriminately when the engine is hot. To prevent such indiscriminate use, a disabling device 73 in the form of a temperature-responsive switch is connected in series with the control switch 72 and located in the engine compartment. When the engine temperature exceeds a predetermined maximum, the disabling device 73 breaks the circuit so that the injector 10 cannot be operated.

Other arrangements for connecting the injector 10 to the engine are possible. For example, either of the alternative lines 67 and 68 for supplying air pressure can be used alone. In the case of a vehicle equipped with an electric starter but having an on-board compressed air system that serves another purpose, such as the operation of air brakes, the electric control switch 72 can be connected to the starter system of the vehicle for automatic operation.

It will be appreciated that the invention uniquely utilizes the on-board compressed air syste 12 of the vehicle to provide a starting fluid injector 10 that is reliable, of simple construction, and of relatively low cost. It is small, lightweight and compact, and can be readily connected to existing vehicles of a wide variety of conventional designs without extensive modification.

It will be understood from the following that while particular forms of the invention have been illustrated and described, various modifications can be made without departing from the spirit and scope of the invention. Accordingly, it is not intended that the invention be limited except as by the appended claims.

I claim:

1. In a vehicle having an on-board compressed air system and an internal combustion engine including a plurality of cylinders, an injector apparatus for supplying starting fluid to the cylinders of said engine when said engine is being started, said injector apparatus comprising:

a starting fluid reservoir;

a metering chamber;

a first fluid path connecting said reservoir to said metering chamber;

first valve means for controlling the outward flow of fluid from said reservoir;

a starting fluid delivery outlet;

a second fluid path connecting said metering chamber to said delivery outlet;

second valve means for controlling the flow of fluid from said metering chamber to said fluid delivery outlet;

actuator means for operating said first and second valve means in sequence to exhaust said metering chamber through said fluid-delivery outlet and then to refill said metering chamber from said reservoir, said actuator means comprising an air cylinder, a piston reciprocable within said air cylinder and operatively associated with said first and second valve means, a compressed air inlet permitting operation of said piston by supplying compressed air to said air cylinder, and an air escape outlet allowing air to escape from said system through said piston at a controlled rate; and an air line connecting said on-board compressed air system to said compressed air inlet whereby said actuator means is operated by said on-board compressed air system.

2. The apparatus of claim 1 wherein said on-board compressed air system is an air starter system for said engine.

3. The apparatus of claim 1 further comprising an additional air line connecting said reservoir to said on-board compressed air system, thereby pressurizing said reservoir.

4. The apparatus of claim 1 wherein said actuator means further comprises piston bias means for resiliently urging said piston toward one end of said air cylinder.

5. The injector apparatus of claim 4 wherein said piston bias means comprises a coil spring disposed within said air cylinder.

6. The injector apparatus of claim 1 wherein said air escape means comprises an aperture in said piston.

7. The injector apparatus of claim 6 wherein said air escape means is an aperture formed in said piston.

8. The injector apparatus of claim 1 further comprising a mounting block to which said reservoir, metering chamber and air cylinder are attached, said block defining said first and second fluid paths.

9. The injector apparatus of claim 8 wherein said air cylinder is threadedly attached to said block.

10. The injector apparatus of claim 8 further comprising a bracket for supporting said apparatus, said mounting block being made up of two block pieces and said bracket having a plate extending between said block pieces.

11. The apparatus of claim 1 wherein said second valve means includes a closure member connected to said piston and a sealing member engageable by said closure member.

12. The apparatus of claim 11 further comprising an operating member extending from said closure member and engageable with said first valve means.

13. In a vehicle having an on-board compressed air system and an internal combustion engine including a plurality of cylinders, an injector apparatus for supplying starting fluid to the cylinders of said engine when said engine is being started, said injector apparatus comprising:

an enclosed, air-tight tank for storing starting fluid under pressure, said tank having an air inlet and a starting fluid outlet;

a mounting block on which said tank is mounted, said block having a bore extending therethrough in communication with said starting fluid outlet;

first valve means disposed within said starting fluid outlet for controlling the outward flow of starting fluid from said tank into said bore;

a metering camber attached to said mounting block in communication with said bore;

a starting fluid delivery outlet in said mounting block in communication with said bore;

an air cylinder attached to said mounting block in opposed relation to said tank;

a piston disposed within said air cylinder for reciprocation toward and away from said tank;

piston bias means for resiliently urging said piston toward said tank;

an operating air inlet in communication with the interior of said air cylinder on the opposite side of said piston from said piston bias means;

an air line connecting said operating air inlet to said on-board compressed air system;

air escape means for permitting air to escape from said system at a controlled rate;

a closure member disposed within said bore and connected to said piston for movement therewith;

a sealing member engageable by said closure member to form second valve means for controlling the flow of fluid from said metering chamber through said bore to said starting fluid delivery outlet; and an operating member disposed within said bore and connected to said closure member to operate said first valve means;

whereby said piston normally maintains said first valve means open and said second valve means closed but causes said first valve means to close and said second valve means to open when compressed air is admitted to said cylinder.

14. The apparatus of claim 13 further comprising an additional air line connecting said air inlet of said reservoir to said on-board compressed air system, thereby pressurizing said reservoir.

15. The injector apparatus of claim 13 further comprising a bracket for supporting said apparatus, said mounting block being made up of two block pieces and said bracket having a plate extending between said block pieces.

16. The apparatus of claim 13 wherein said sealing member has the shape of a ring and is disposed within said bore.

17. The apparatus of claim 13 wherein said air escape means comprises an aperture formed in said piston.

18. The apparatus of claim 13 further comprising control means for supplying compressed air to said operating air inlet in response to an electrical signal.

19. The apparatus of claim 13 further comprising disabling means for preventing operation of said control means at temperatures exceeding a predetermined maximum.

20. In a vehicle having an on-board compressed air system, an internal combustion engine including a plurality of cylinders, and an injector apparatus for supplying starting fluid to the cylinders of said engine when said engine is being started, said apparatus comprising:

an enclosed air-tight tank for storing starting fluid under pressure, said tank having an air inlet and a starting fluid outlet;

a first air line connecting said tank air inlet to said compressed air system;

a metering chamber;

a first fluid path connecting said tank to said metering chamber;

first valve means for controlling the outward flow of starting fluid from said tank to said metering chamber;

a starting fluid delivery outlet;

a second fluid path connecting said metering chamber to said delivery outlet;

a starting fluid delivery line connecting said delivery outlet to the cylinders of said engine;

second valve means for controlling the flow of starting fluid from said metering chamber to said delivery outlet; and actuator means for operating said first and second valve means in sequence to exhaust said metering chamber through said starting fluid delivery outlet in cooperation with said exhaust means and then to refill said metering chamber from said tank, said actuator means comprising:

an air cylinder;

a piston reciprocable within said cylinder and operatively associated with said first and second valve means;

piston bias means for resiliently biasing said piston toward said bore; and a second air line communicating with a portion of the interior of said cylinder on the opposite side of said piston from said piston bias means to supply compressed air to said cylinder, causing said piston to move within said cylinder against the force of said piston bias means.

21. The apparatus of claim 20 wherein said piston bias means is a coil spring disposed within said cylinder.

22. The apparatus of claim 20 further comprising control means responsive to an electrical signal for controlling the flow of compressed air through said second air line.

23. The apparatus of claim 22 further comprising disabling means for preventing operation of said control means at temperatures exceeding a predetermined maximum.

24. The apparatus of claim 20 wherein said second air line is arranged to receive compressed air upon operation of an air starter in said vehicle.

25. The apparatus of claim 20 wherein said second valve means includes a closure member connected to said piston and a sealing member engageable by said closure member.

26. The apparatus of claim 25 further comprising an operating member extending from said closure member and engageable with said first valve means.

27. The apparatus of claim 13 further comprising resilient exhaust means for expelling fluid from said metering chamber.

28. The apparatus of claim 20 further comprising resilient exhaust means for expelling fluid from said metering chamber.

* * * * *